US009287033B2

(12) United States Patent
Matsuura et al.

(10) Patent No.: US 9,287,033 B2
(45) Date of Patent: Mar. 15, 2016

(54) MAGNETIC MATERIAL AND COIL COMPONENT USING SAME

(71) Applicant: TAIYO YUDEN CO., LTD., Taito-ku, Tokyo (JP)

(72) Inventors: Hitoshi Matsuura, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 14/162,427

(22) Filed: Jan. 23, 2014

(65) Prior Publication Data

US 2014/0139311 A1 May 22, 2014

Related U.S. Application Data

(63) Continuation of application No. 14/113,801, filed as application No. PCT/JP2011/073559 on Oct. 13, 2011, now Pat. No. 9,030,285.

(30) Foreign Application Priority Data

Apr. 27, 2011 (JP) ..... 2011-100095

(51) Int. Cl.
*H01F 27/24* (2006.01)
*H01F 27/255* (2006.01)
(Continued)

(52) U.S. Cl.
CPC ..... *H01F 27/255* (2013.01); *C22C 38/34* (2013.01); *H01F 1/24* (2013.01); *H01F 1/33* (2013.01);
(Continued)

(58) Field of Classification Search
CPC ..... H01F 27/00–27/30
USPC ..... 336/233–234, 65, 83, 221–232
See application file for complete search history.

(56) References Cited

U.S. PATENT DOCUMENTS 2,193,768 A 3/1940 Masumoto et al.
4,129,444 A 12/1978 Dreyer et al.
(Continued)

FOREIGN PATENT DOCUMENTS

CN 1731542 A 2/2006
CN 101308719 A 11/2008
(Continued)

OTHER PUBLICATIONS

A Notification of Examination Opinions with Search Report issued by Taiwan Intellectual Property Office, mailed Feb. 10, 2014, for Taiwan counterpart application No. 100141341.
(Continued)

*Primary Examiner* — Tuyen Nguyen
(74) *Attorney, Agent, or Firm* — Law Office of Katsuhiro Arai

(57) ABSTRACT

A magnetic material contains multiple metal grains constituted by soft magnetic alloy and oxide film formed on a surface of the metal grains, which soft magnetic alloy includes Fe and a metal element that oxidizes more easily than Fe, wherein the magnetic material forms a grain compact having first bonding parts where adjacent metal grains are contacted and directly bonded together, second bonding parts where adjacent metal grains are bonded together via the oxide film formed around the entire surface of said adjacent metal grains other than the first bonding parts, and voids formed in an area other than the first and second bonding parts and surrounded by the oxide film.

10 Claims, 5 Drawing Sheets

(51) Int. Cl.

| | |
|---|---|
| ***H01F 1/24*** | (2006.01) |
| ***H01F 1/33*** | (2006.01) |
| ***H01F 41/02*** | (2006.01) |
| ***C22C 38/34*** | (2006.01) |
| ***H01F 5/00*** | (2006.01) |
| *H01F 1/147* | (2006.01) |

(52) U.S. Cl.

CPC ..... *H01F 5/00* (2013.01); *H01F 27/24* (2013.01); *H01F 41/0246* (2013.01); *B22F 2998/00* (2013.01); *B22F 2998/10* (2013.01); *C22C 2202/02* (2013.01); *H01F 1/14783* (2013.01); *H01F 1/14791* (2013.01); *Y10T 428/249956* (2015.04)

(56) References Cited

U.S. PATENT DOCUMENTS

| | | | | |
|---|---|---|---|---|
| 4,921,763 | A * | 5/1990 | Karamon | 428/836.3 |
| 5,352,522 | A | 10/1994 | Kugimiya et al. | |
| 5,522,946 | A | 6/1996 | Tomita et al. | |
| 5,997,999 | A | 12/1999 | Horiuchi et al. | |
| 6,051,324 | A * | 4/2000 | Moorhead et al. | 428/552 |
| 6,392,525 | B1 | 5/2002 | Kato et al. | |
| 6,515,568 | B1 | 2/2003 | Maki et al. | |
| 6,764,643 | B2 | 7/2004 | Sagawa et al. | |
| 6,784,782 | B2 | 8/2004 | Inoue et al. | |
| 6,814,928 | B2 | 11/2004 | Sagawa et al. | |
| 7,422,697 | B2 | 9/2008 | Takahashi et al. | |
| 7,446,638 | B2 | 11/2008 | Nogi | |
| 7,719,399 | B2 | 5/2010 | Iwasaki | |
| 7,843,701 | B2 | 11/2010 | Kudo et al. | |
| 8,018,313 | B2 | 9/2011 | Tada et al. | |
| 8,416,051 | B2 | 4/2013 | Matsuura et al. | |
| 8,427,265 | B2 * | 4/2013 | Hachiya et al. | 336/83 |
| 8,866,579 | B2 * | 10/2014 | Hachiya et al. | 336/200 |
| 8,896,405 | B2 * | 11/2014 | Hachiya et al. | 336/200 |
| 2004/0086412 | A1 | 5/2004 | Suzuki et al. | |
| 2004/0140016 | A1 | 7/2004 | Sakamoto et al. | |
| 2004/0209120 | A1 | 10/2004 | Inoue et al. | |
| 2005/0199852 | A1 | 9/2005 | Takenoshita | |
| 2007/0159282 | A1 | 7/2007 | Huang et al. | |
| 2007/0290161 | A1 | 12/2007 | Tokuoka et al. | |
| 2008/0003126 | A1 | 1/2008 | Watanabe et al. | |
| 2008/0012679 | A1 | 1/2008 | Okabe et al. | |
| 2008/0029300 | A1 | 2/2008 | Harada et al. | |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2008/0278273 | A1 | 11/2008 | Lee et al. | |
| 2009/0003191 | A1 | 1/2009 | Inuzuka et al. | |
| 2009/0045905 | A1 | 2/2009 | Nakagawa et al. | |
| 2009/0102589 | A1 | 4/2009 | Lee et al. | |
| 2009/0140833 | A1 | 6/2009 | Tan et al. | |
| 2009/0184794 | A1 | 7/2009 | Tsuzuki et al. | |
| 2009/0302512 | A1 | 12/2009 | Gablenz et al. | |
| 2010/0033286 | A1 | 2/2010 | Katayama et al. | |
| 2010/0044618 | A1 | 2/2010 | Ishimine et al. | |
| 2010/0045120 | A1 | 2/2010 | Kitano et al. | |
| 2010/0253463 | A1 | 10/2010 | Shimomura et al. | |
| 2010/0287764 | A1 | 11/2010 | McGregor et al. | |
| 2010/0289609 | A1 | 11/2010 | Liao et al. | |
| 2011/0024670 | A1 | 2/2011 | Otsuki et al. | |
| 2011/0024671 | A1 | 2/2011 | Otsuki et al. | |
| 2011/0133881 | A1 | 6/2011 | Nakajima et al. | |
| 2011/0181384 | A1 | 7/2011 | Inuduka et al. | |
| 2011/0227690 | A1 * | 9/2011 | Watanabe et al. | 336/221 |
| 2011/0267167 | A1 | 11/2011 | Ogawa et al. | |
| 2011/0285486 | A1 | 11/2011 | Maeda et al. | |
| 2012/0001710 | A1 | 1/2012 | Wakabayashi et al. | |
| 2012/0038449 | A1 | 2/2012 | Ogawa et al. | |
| 2012/0070567 | A1 | 3/2012 | Watanabe et al. | |
| 2012/0229244 | A1 | 9/2012 | Ueno et al. | |
| 2013/0154786 | A1 | 6/2013 | Nakajima et al. | |
| 2013/0271256 | A1 | 10/2013 | Ueno et al. | |

FOREIGN PATENT DOCUMENTS

| | | | |
|---|---|---|---|
| CN | 101927344 | A | 12/2010 |
| CN | 102007549 | A | 4/2011 |
| JP | H04-147903 | A | 5/1992 |
| JP | H04-346204 | A | 12/1992 |
| JP | H07-201570 | A | 8/1995 |
| JP | H09-074011 | A | 3/1997 |
| JP | H10-241942 | A | 9/1998 |
| JP | 2000-030925 | A | 1/2000 |
| JP | 2000-138120 | A | 5/2000 |
| JP | 2001-011563 | A | 1/2001 |
| JP | 2001-118725 | A | 4/2001 |
| JP | 2002-305108 | A | 10/2002 |
| JP | 2002-313620 | A | 10/2002 |
| JP | 2002-313672 | A | 10/2002 |
| JP | 2002-343618 | A | 11/2002 |
| JP | 2004-162174 | A | 6/2004 |
| JP | 2005-150257 | A | 6/2005 |
| JP | 2005-286145 | A | 10/2005 |
| JP | 2007-019134 | A | 1/2007 |
| JP | 2007-027354 | A | 2/2007 |
| JP | 2007-123703 | A | 5/2007 |
| JP | 2007-258427 | A | 10/2007 |
| JP | 2007-299871 | A | 11/2007 |
| JP | 2008-028162 | A | 2/2008 |
| JP | 2008-041961 | A | 2/2008 |
| JP | 2008-195986 | A | 8/2008 |
| JP | 2009-010180 | A | 1/2009 |
| JP | 2009-088496 | A | 4/2009 |
| JP | 2009-088502 | A | 4/2009 |
| JP | 2009088502 | A * | 4/2009 |
| JP | 2010-018823 | A | 1/2010 |
| JP | 2011-249774 | A | 12/2011 |
| TW | 200845057 | A | 11/2008 |
| TW | M388724 | U1 | 9/2010 |
| WO | 2009/001641 | A1 | 12/2008 |
| WO | 2009/128425 | A1 | 10/2009 |
| WO | 2009/128427 | A1 | 10/2009 |
| WO | 2010/013843 | A1 | 2/2010 |
| WO | 2011/001958 | A1 | 1/2011 |

OTHER PUBLICATIONS

A Notification of Reasons for Refusal issued by the Japanese Patent Office, mailed Jun. 9, 2014, for Japanese counterpart application No. 2013-511866.

A European Office Action, mailed May 20, 2014, issued for a counterpart European Application No. 12002109.

A Notification of Examination Opinions with Search Report issued by Taiwan Intellectual Property Office, mailed Mar. 25, 2014, for Taiwan counterpart application No. 101112339.

International Search Report mailed Nov. 22, 2011, issued for International application No. PCT/JP2011/073559.

Non-final Office action issued by the USPTO, dated Aug. 16, 2012, for related U.S. Pat. No. 8,416,051.

Notice of Allowance issued by the USPTO, mailed Dec. 26, 2012, for related U.S. Pat. No. 8,416,051.

An Office Action issued by the State Intellectual Property Office of China, mailed Dec. 29, 2014, for Chinese counterpart application No. 201210125516.X.

An Office Action issued by the Korean Intellectual Property Office, mailed Dec. 23, 2014, for related Korean application No. 10-2013-7026362.

Non-Final Rejection issued by U.S. Patent and Trademark Office, dated Aug. 25, 2014, for U.S. Appl. No. 14/113,801.

* cited by examiner

MAGNETIC MATERIAL AND COIL COMPONENT USING SAME

CROSS-REFERENCE TO RELATED APPLICATIONS

This application is a continuation of U.S. patent application Ser. No. 14/113,801, filed Oct. 24, 2013, and claims the benefits thereof under U.S.C. §121 or §365(c), which is the U.S. National Phase under 35 U.S.C. §371 of International Application PCT/JP2011/073559, filed Oct. 13, 2011, which claims priority to Japanese Patent Application No. 2011-100095, filed Apr. 27, 2011, each disclosure of which is herein incorporated by reference in its entirety. The International Application was published under PCT Article 21 (2) in the language other than English.

The applicant(s) herein explicitly rescind(s) and retract(s) any prior disclaimers or disavowals made in any parent, child or related prosecution history with regard to any subject matter supported by the present application.

BACKGROUND OF THE INVENTION

1. Field of the Invention

The present invention relates to a magnetic material used primarily as a magnetic core in a coil, inductor, etc., as well as a coil component using such magnetic material.

2. Description of the Related Art

Coil components such as inductors, choke coils and transformers (so-called inductance components) have a magnetic material and a coil formed inside or on the surface of the magnetic material. For the magnetic material, Ni—Cu—Zn ferrite or other type of ferrite is generally used.

There has been a need for these coil components of larger current capacity (higher rated current) in recent years, and switching the magnetic material from ferrite as traditionally used, to Fe—Cr—Si alloy, is being studied in order to meet such demand (Japanese Patent Laid-open No. 2007-027354). Fe—Cr—Si alloy and Fe—Al—Si alloy have a higher saturated magnetic flux density than ferrite. On the other hand, their volume resistivity is much lower than that of ferrite.

Japanese Patent Laid-open No. 2007-027354 discloses a method of manufacturing the magnetic material part of a laminated coil component, which is to form magnetic layers using a magnetic paste containing Fe—Cr—Si alloy grains and glass component, laminate the magnetic layers with conductive patterns and sinter the laminate in a nitrogen ambience (reducing ambience), and then impregnate the sintered laminate with thermosetting resin.

SUMMARY OF THE INVENTION

However, the manufacturing method described in Japanese Patent Laid-open No. 2007-027354 leaves in the magnetic material part the glass component contained in the magnetic paste, and this glass component in the magnetic material part reduces the volume ratio of Fe—Cr—Si alloy grains and consequently the saturated magnetic flux density of the component drops, as well.

In the meantime, the pressed powder magnetic core formed with a binder mixed together is known as a type of inductor utilizing metal magnetic material. General pressed powder magnetic cores have low insulation resistance and therefore electrodes cannot be attached directly.

In consideration of the above, the object of the present invention is to provide a new magnetic material capable of improving both insulation resistance and magnetic permeability, and also provide a coil component using such magnetic material.

After studying in earnest, the inventors completed the present invention described below.

The magnetic material conforming to the present invention is constituted by a grain compact, which is made by compacting metal grains on which oxide film is formed. The metal grains are constituted by Fe—Si—M soft magnetic alloy (where M is a metal element that oxidizes more easily than Fe), and the grain compact has bonding parts where adjacent metal grains are bonded together via the oxide film formed on their surface, as well as bonding parts where metal grains are directly bonded together in areas where no oxide film exists. Here, "bonding parts where metal grains are directly bonded together in areas where no oxide film exists" are metal parts of adjacent metal grains in direct contact with each other, where this concept includes, for example, metal bond in a strict sense, a mode where metal parts are in direct contact with each other in a manner not exchanging atoms, and a mode in between. Metal bond in a strict sense means that certain requirements such as "regularity of atomic arrangement" are satisfied.

In addition, the oxide film is an oxide of Fe—Si—M soft magnetic alloy (where M is a metal element that oxidizes more easily than Fe), and preferably its mol ratio of the metal element denoted by M to the Fe element is greater than that of the metal grain.

Also, preferably the ratio B/N, where N represents the number of metal grains in a cross section of the grain compact and B represents the number of bonding parts where metal grains are directly bonded together, is 0.1 to 0.5.

Also, preferably the magnetic material conforming to the present invention is obtained by compacting multiple metal grains manufactured by the atomization method and then heat-treating the compact in an oxidizing ambience.

Also, preferably the grain compact has voids inside and at least some of the voids are impregnated with polymer resin.

According to the present invention, a coil component having the aforementioned magnetic material and a coil formed inside or on the surface of the magnetic material is also provided.

According to the present invention, a magnetic material offering both high magnetic permeability and high insulation resistance is provided, and a coil component using this material can have electrodes directly attached to it.

DESCRIPTION OF THE SYMBOLS

Figure 1:
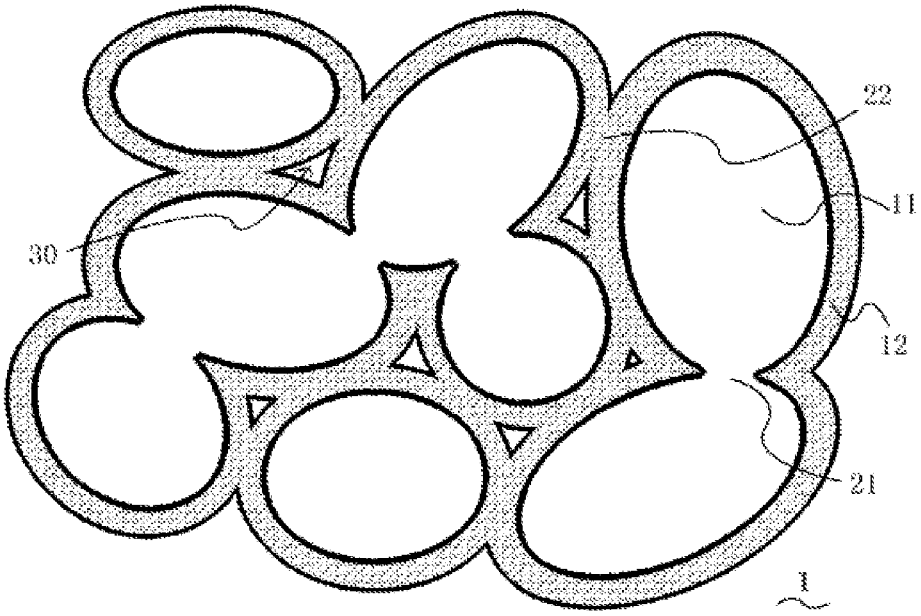
FIG. 1 is a section view providing a schematic illustration of the fine structure of a magnetic material conforming to the present invention.

1, 2: Grain compact, 11: Metal grain, 12: Oxide film, 21: Bonding part where metal grains are directly bonded together, 22: Bonding part via oxide film, 30: Void, 31: Polymer resin, 110: Magnetic material, 111, 112: Magnetic core, 114: External conductive film, 115: Coil, 210: Laminated inductor, 211: Component body, 212: Magnetic material part, 213: Coil, 214, 215: External terminal

DETAILED DESCRIPTION OF EMBODIMENTS

The present invention is described in detail by referring to the drawings as appropriate. It should be noted, however, that the present invention is not at all limited to the illustrated embodiments and that, because the characteristic parts of the invention may be emphasized in the drawings, the scale of each part of the drawings is not necessarily accurate.

According to the present invention, the magnetic material is constituted by a grain compact, which is made by compacting specified grains.

Under the present invention, the magnetic material is what functions as a magnetic path in a coil, inductor or other magnetic component, and typically takes the form of a magnetic core of coil, etc.

FIG. 1 is a section view providing a schematic illustration of the fine structure of a magnetic material conforming to the present invention. Under the present invention, microscopically a grain compact 1 is understood as an aggregate of many metal grains 11 that were originally independent, where the individual metal grains 11 have oxide film 12 formed almost all around them and this oxide film 12 ensures insulation property of the grain compact 1. Adjacent metal grains 11 are bonded together primarily via the oxide film 12 around them, to constitute the grain compact 1 having a specific shape. According to the present invention, adjacent metal grains 11 are bonded together at their metal parts in some areas (indicated by numeral 21). In the Specification, metal grains 11 are grains constituted by the alloy material described later, and may be referred to as "metal part" or "core" if the exclusion of oxide film 12 is to be particularly emphasized. Traditionally used magnetic materials include one constituted by a hardened organic resin matrix in which magnetic grains or several magnetic grain bonds are dispersed, and one constituted by a hardened glass component matrix in which magnetic grains or several magnetic grain bonds are dispersed. Under the present invention, preferably neither an organic resin matrix nor glass component matrix is virtually present.

The individual metal grains 11 are primarily constituted by specific soft magnetic alloy. Under the present invention, the metal grain 11 is constituted by Fe—Si—M soft magnetic alloy. Here, M is a metal element that oxidizes more easily than Fe, and typically Cr (chromium), Al (aluminum), Ti (titanium), etc., and preferably Cr or Al.

The content of Si in the Fe—Si—M soft magnetic alloy is preferably 0.5 to 7.0 percent by weight, or more preferably 2.0 to 5.0 percent by weight. This is because the greater the content of Si, the better in terms of higher resistivity and higher magnetic permeability, while the smaller the content of Si, the better the compacting property becomes.

If M above is Cr, then the content of Cr in the Fe—Si—M soft magnetic alloy is preferably 2.0 to 15 percent by weight, or more preferably 3.0 to 6.0 percent by weight. Presence of Cr is preferred in that it becomes passive under heat treatment to suppress excessive oxidization while expressing strength and insulation resistance, but from the viewpoint of improving magnetic characteristics, less Cr is preferred, and the aforementioned preferable ranges are proposed in consideration of the foregoing.

If M above is Al, then the content of Al in the Fe—Si—M soft magnetic alloy is preferably 2.0 to 15 percent by weight, or more preferably 3.0 to 6.0 percent by weight. Presence of Al is preferred in that it becomes passive under heat treatment to suppress excessive oxidization while expressing strength and insulation resistance, but from the viewpoint of improving magnetic characteristics, less Al is preferred, and the aforementioned preferable ranges are proposed in consideration of the foregoing.

It should be noted that the preferable contents of each metal component in the Fe—Si—M soft magnetic alloy as mentioned above assume that the total amount of all alloy component represents 100 percent by weight. In other words, oxide film composition is excluded in the calculations of preferable contents above.

In the Fe—Si—M soft magnetic alloy, the remainder of Si and metal M is preferably Fe except for unavoidable impurities. Metals that can be contained besides Fe, Si and M include Mn (manganese), Co (cobalt), Ni (nickel), and Cu (copper), among others.

The chemical composition of the alloy constituting each metal grain 11 in the grain compact 1 can be calculated, for example, by capturing a cross section of the grain compact 1 using a scanning electron microscope (SEM) and then calculating the composition by the ZAF method based on energy dispersive X-ray spectroscopy (EDS).

The individual metal grains 11 constituting the grain compact 1 have oxide film 12 formed around them. It can be said that there are a core (or metal grain 11) constituted by the aforementioned soft magnetic alloy, and oxide film 12 formed around the core. The oxide film 12 may be formed in the material grain stage before the grain compact 1 is formed, or it may be generated in the compacting stage by keeping oxide film absent or minimum in the material grain stage. Presence of oxide film 12 can be recognized as a contrast (brightness) difference on an image taken by the scanning electron microscope (SEM) at a magnification of around ×3000. Presence of oxide film 12 assures insulation property of the magnetic material as a whole.

The oxide film 12 only needs to be a metal oxide, and preferably the oxide film 12 is an oxide of Fe—Si—M soft magnetic alloy (where M is a metal element that oxidizes more easily than Fe) and its mol ratio of the metal element denoted by M to the Fe element is greater than that of the metal grain. Methods to obtain oxide film 12 having this constitution include keeping the content of Fe oxide in the material grain for magnetic material minimal or zero whenever possible, and oxidizing the alloy surface by heat treatment or other means in the process of obtaining the grain compact 1. This way, metal M that oxidizes more easily than Fe is selectively oxidized and consequently the mol ratio of metal M to Fe in the oxide film 12 becomes relatively greater than the mol ratio of metal M to Fe in the metal grain 11. Containing the metal element denoted by M more than the Fe element in the oxide film 12 has the benefit of suppressing excessive oxidization of the alloy grain.

The method of measuring the chemical composition of the oxide film 12 in the grain compact 1 is as follows. First, the grain compact 1 is fractured or otherwise its cross section is exposed. Next, the cross section is smoothed by means of ion milling, etc., and then captured with a scanning electron microscope (SEM), followed by composition calculation of the oxide film 12 area according to the ZAF method based on energy dispersive X-ray spectroscopy (EDS).

The content of metal M in oxide film 12 is preferably 1.0 to 5.0 mol, or more preferably 1.0 to 2.5 mol, or even more preferably 1.0 to 1.7 mol, per 1 mol of Fe. Any higher content is preferable in terms of suppressing excessive oxidization, while any lower content is preferable in terms of sintering the space between metal grains. Methods to increase the content includes heat-treating in a weak oxidizing ambience, for example, while the methods to decrease the content includes heat-treating in a strong oxidizing ambience, for example.

In the grain compact 1, grains are bonded together primarily by bonding parts 22 via oxide film 12. Presence of bonding parts 22 via oxide film 12 can be clearly determined by, for example, visually confirming on a SEM observation image magnified to approx. 3000 times, etc., that the oxide film 12 of a metal grain 11 has the same phase as the oxide film 12 of an adjacent metal grain 11. For example, even if the oxide film 12 of a metal grain 11 contacts the oxide film 12 of an adjacent metal grain 11, a location where the interface of these adjacent oxide films 12 is visually confirmed on a SEM observation image, etc., is not necessarily a bonding part 22 via oxide film 12. Presence of bonding parts 22 via oxide film 12 improves mechanical strength and insulation property. Preferably adjacent metal grains 11 are bonded together via their oxide film 12 throughout the grain compact 1, but mechanical strength and insulation property improve to some extent so long as some grains are bonded this way, and such mode is also considered an embodiment of the present invention. In addition, metal grains 11 are bonded together not via oxide film 12 in some areas, as described later. Furthermore, a mode is permitted in some areas where adjacent metal grains 11 are physically contacting or in close proximity with each other in the absence of bond via oxide film 12 or direct bond of metal grains 11.

Methods to generate bonding parts 22 via oxide film 12 include, for example, applying heat treatment at the specific temperature mentioned later in an ambience of oxygen (such as in air) during the manufacture of grain compact 1.

According to the present invention, the grain compact 1 not only has bonding parts 22 via oxide film 12 but also has bonding parts 21 where metal grains 11 are directly bonded together. As is the case with bonding parts 22 via oxide film 12 as mentioned above, presence of bonding parts 21 where metal grains 11 are directly bonded together can be clearly determined by, for example, observing a photograph of cross section such as a SEM observation image magnified to approx. 3000 times, etc., to visually confirm a bonding point at which adjacent metal grains 11 do not have any oxide film in between in a location where a relatively deep concaving of the grain surface curve is observed and the curves of what were originally the surfaces of two grains are likely intersecting with each other. Improvement of magnetic permeability by the presence of bonding parts 21 where metal grains 11 are directly bonded together is one key effect of the present invention.

Methods to generate bonding parts 21 where metal grains 11 are bonded directly together include, for example, using material grains having less oxide film on them, adjusting the temperature and partial oxygen pressure as described later during the heat treatment needed to manufacture the grain compact 1, and adjusting the compacting density at which to obtain the grain compact 1 from the material grains. Preferably the heat treatment temperature is sufficient to bond the metal grains 11 together, while keeping the generation of oxide to a minimum, where the specific preferable temperature ranges are mentioned later. The partial oxygen pressure may be that in air, for example, and the lower the partial oxygen pressure, the less likely the generation of oxide becomes and consequently the more likely the direct bonding of metal grains 11 becomes.

According to a favorable embodiment of the present invention, most bonding parts between adjacent metal grains 11 are bonding parts 22 via oxide film 12, and bonding parts 21 where metal grains are directly bonded together are present in some areas. The degree of presence of bonding parts 21 where metal grains are directly bonded together can be quantified as follows. The grain compact 1 is cut and a SEM observation image of its cross section is obtained at a magnification of approx. ×3000. The view field, etc., are adjusted so that 30 to 100 metal grains 11 are captured by the SEM observation image. The number of metal grains 11, or N, and number of bonding parts 21 where metal grains 11 are directly bonded together, or B, are counted on the observation image. The ratio B/N of these values is used as an indicator to evaluate the degree of presence of bonding parts 21 where metal grains are directly bonded together. How to count N and B is explained by using the embodiment in FIG. 1 as an example. If the image in FIG. 1 is obtained, the number of metal grains 11, or N, is 8, the number of bonding parts 21, or B, is 4. Accordingly, the ratio B/N is 0.5 in this embodiment. Under the present invention, the ratio B/N is preferably 0.1 to 0.5, or more preferably 0.1 to 0.35, or even more preferably 0.1 to 0.25. Since a greater B/N improves magnetic permeability, while a smaller B/N improves insulation resistance, the above preferable ranges are presented in consideration of balancing between magnetic permeability and insulation resistance.

The magnetic material conforming to the present invention can be manufactured by compacting metal grains constituted by a specific alloy. At this time, a grain compact whose shape is more desirable overall can be obtained by causing adjacent metal grains to bond primarily via oxide film, while allowing them to bond without oxide film in some areas.

For the metal grain used as material (hereinafter also referred to as "material grain"), primarily a grain constituted by Fe—Si—M soft magnetic alloy is used. The alloy composition of the material grain is reflected in the alloy composition of the magnetic material finally obtained. Accordingly, an appropriate alloy composition of material grain can be selected according to the alloy composition of magnetic material to be finally obtained, where preferable composition ranges are the same as the preferable composition ranges of the magnetic material mentioned above. The individual material grains may be covered with oxide film. In other words, the individual material grains may be constituted by a core made of specified soft magnetic alloy and oxide film covering the periphery of the core at least partially.

The size of each material grain is virtually equivalent to the size of the grain constituting the grain compact in the magnetic material finally obtained. The size of the material grain is preferably a d50 of 2 to 30 μm, or more preferably that of 2 to 20 μm, when magnetic permeability and in-grain eddy current loss are considered, where a more preferable lower limit of d50 is 5 μm. The d50 of the material grain can be measured using a laser diffraction/scattering measuring system.

The material grain is manufactured by the atomization method, for example. As mentioned earlier, the grain compact 1 not only has bonding parts 22 via oxide film 12, but it also has bonding parts 21 where metal grains 11 are directly bonded together. Accordingly, oxide film may be present on the material grain, but not excessively. The grain manufactured by the atomization method is preferred in that it has relatively less oxide film. The ratio of alloy core and oxide film in the material grain can be quantified as follows. The material grain is analyzed by XPS by focusing on the peak intensity of Fe, and the integral value of peaks at which Fe exists as metal (706.9 eV), or $Fe_{Metal}$, and integral value of peaks at which Fe exists as oxide, or $Fe_{Oxide}$, are obtained, after which $Fe_{Metal}/(Fe_{Metal}+Fe_{Oxide})$ is calculated to quantify the ratio. Here, the calculation of $Fe_{Oxide}$ involves fitting with the measured data based on normal distribution layering around the binding energies of three types of oxides, namely $Fe_2O_3$ (710.9 eV), FeO (709.6 eV) and $Fe_3O_4$ (710.7 eV). As a result, $Fe_{Oxide}$ is calculated as the sum of integral areas isolated by peaks. Preferably the above value is 0.2 or greater from the viewpoint of enhancing the magnetic permeability as a result of promoting the generation of alloy-alloy bonding parts 21 during heat treatment. The upper limit of the above value is not specified in any way, but it can be 0.6, for example, from the viewpoint of manufacturing ease, and a preferable upper limit is 0.3. Methods to raise the above value include heat-treating in a reducing ambience, removing the surface oxide layer using acid or applying other chemical treatment, for example. Reduction process can be implemented by, for example, holding the target at 750 to 850° C. for 0.5 to 1.5 hours in an ambience of nitrogen or argon containing 25 to 35% of hydrogen. Oxidization process can be implemented by, for example, holding the target at 400 to 600° C. for 0.5 to 1.5 hours in air.

For the aforementioned material grain, any known alloy grain manufacturing method may be adopted, or PF20-F by Epson Atmix, SFR—FeSiAl by Nippon Atomized Metal Powders or other commercial product may be used. If a commercial product is used, it is highly likely that the aforementioned value of $Fe_{Metal}/(Fe_{Metal}+Fe_{Oxide})$ is not considered and therefore it is preferable to screen material grains or apply the aforementioned heat treatment, chemical treatment or other pretreatment.

The method to obtain a compact from the material grain is not limited in any way, and any known means for grain compact manufacturing can be adopted as deemed appropriate. The following explains a typical manufacturing method of compacting the material grains under non-heating conditions and then applying heat treatment. However, the present invention is not at all limited to this manufacturing method.

When compacting the material grains under non-heating conditions, it is preferable to add organic resin as binder. For the organic resin, it is preferable to use one constituted by acrylic resin, butyral resin, vinyl resin, or other resin whose thermal decomposition temperature is 500° C. or below, as less binder will remain after the heat treatment. Any known lubricant may be added at the time of compacting. The lubricant may be organic acid salt, etc., where specific examples include zinc stearate and calcium stearate. The amount of lubricant is preferably 0 to 1.5 parts by weight, or more preferably 0.1 to 1.0 part by weight, relative to 100 parts by weight of material grains. When the amount of lubricant is 0, it means lubricant is not used at all. After adding binder and/or lubricant to the material grains as desired, the mixture is agitated and then compacted to a desired shape. At the time of compacting, 5 to 10 t/cm$^2$ of pressure, for example, may be applied.

A favorable embodiment of heat treatment is explained.

Preferably heat treatment is performed in an oxidizing ambience. To be more specific, the oxygen concentration is preferably 1% or more during heating, as it promotes the generation of both bonding parts 22 via oxide film and bonding parts 21 where metal grains are directly bonded together. Although the upper limit of oxygen concentration is not specified in particular, the oxygen concentration in air (approx. 21%) may be used, for example, in consideration of manufacturing cost, etc. The heating temperature is preferably 600° C. or above from the viewpoint of generating oxide film 12 and thereby promoting the generation of bonding parts via oxide film 12, and 900° C. or below from the viewpoint of suppressing oxidization to an appropriate level in order to maintain bonding parts 21 where metal grains are directly bonded together and thereby enhance magnetic permeability. More preferably the heating temperature is 700 to 800° C. Preferably the heating time is 0.5 to 3 hours from the viewpoint of promoting the generation of both bonding parts 22 via oxide film 12 and bonding parts 21 where metal grains are directly bonded together.

Figure 2:
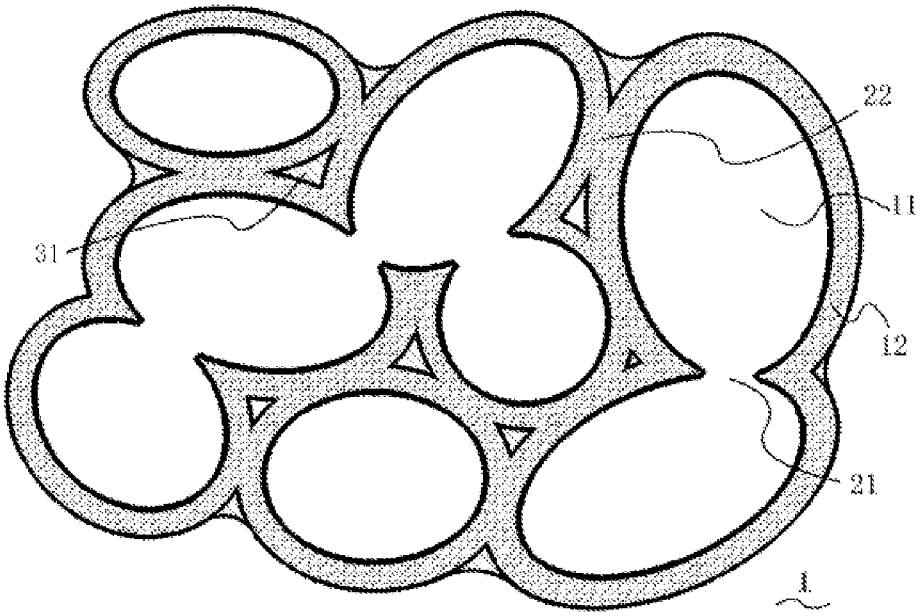
FIG. 2 is a section view providing a schematic illustration of the fine structure of a different example of magnetic material conforming to the present invention.

The obtained grain compact 1 may have voids 30 inside. FIG. 2 is a section view providing a schematic illustration of the fine structure of a different example of magnetic material conforming to the present invention. According to the embodiment shown in FIG. 2, polymer resin 31 is impregnated in at least some of the voids present inside the grain compact 1. Methods to impregnate polymer resin 31 include, for example, soaking the grain compact 1 in polymer resin in liquid state, solution of polymer resin or other liquefied polymer resin, and then lowering the pressure of the manufacturing system, or applying the aforementioned liquefied polymer resin onto the grain compact 1 and letting it seep into the voids 30 near the surface. Impregnating polymer resin in the voids 30 in the grain compact 1 is beneficial in that it increases strength and suppresses hygroscopic property. The polymer resin is not limited in any way and may be epoxy resin, fluororesin or other organic resin, or silicone resin, among others.

The grain compact 1 thus obtained can be used as a magnetic material constituent of various components. For example, the magnetic material conforming to the present invention may be used as a magnetic core, with an insulating sheathed conductive wire wound around it, to form a coil. Or, green sheets containing the aforementioned material grain may be formed using any known method, followed by printing or otherwise applying a conductive paste onto the green sheets in a specific pattern and then laminating the printed green sheets and pressurizing the laminate, followed further by heat treatment under the aforementioned conditions, to obtain an inductor (coil component) having a coil formed inside the magnetic material conforming to the present invention. In addition, various coil components may be obtained by forming a coil inside or on the surface of the magnetic material conforming to the present invention. The coil component can be any of the various mounting patterns such as surface mounting and through-hole mounting, and for the means to obtain a coil component from the magnetic material, including the means to constitute the coil component of any such mounting pattern, what is described in the examples presented later may be referenced or any known manufacturing method in the electronics component field may be adopted as deemed appropriate.

The present invention is explained specifically below using examples. It should be noted, however, that the present invention is not at all limited to the embodiments described in these examples.

EXAMPLE 1

Material Grain

A commercial alloy powder manufactured by the atomization method, having a composition of 4.5 percent by weight of Cr, 3.5 percent by weight of Si and Fe constituting the remainder, and average grain size d50 of 10 μm, was used as the material grain. An aggregate surface of this alloy powder was analyzed by XPS and the aforementioned $Fe_{Metal}/(Fe_{Metal}+Fe_{Oxide})$ was calculated as 0.25.

Manufacturing of Grain Compact

One hundred parts by weight of material grains thus prepared were mixed under agitation with 1.5 parts by weight of acrylic binder whose thermal decomposition temperature was 400° C., after which 0.5 percent by weight of zinc stearate was added as lubricant. Then, the mixture was compacted to a specific shape under 8 t/cm$^2$, and the compact was heat-treated at 750° C. for 1 hour in an oxidizing ambience of 20.6% in oxygen concentration, to obtain a grain compact. When the characteristics of the obtained grain compact were measured, its magnetic permeability was 48 after the heat treatment compared to 36 before the heat treatment. The specific resistance was $2\times10^5$ Ωcm and strength was 7.5 kgf/mm$^2$. A ×3000 SEM observation image of the grain compact was obtained to confirm that the number of metal grains 11, or N, was 42, while the number of bonding parts 21 where metal grains 11 were directly bonded together, or B, was 6, thereby giving a B/N ratio of 0.14. Composition analysis of the oxide film 12 on the obtained grain compact revealed that 1.5 mol of Cr element was contained per 1 mol of Fe element.

COMPARATIVE EXAMPLE 1

Figure 9:
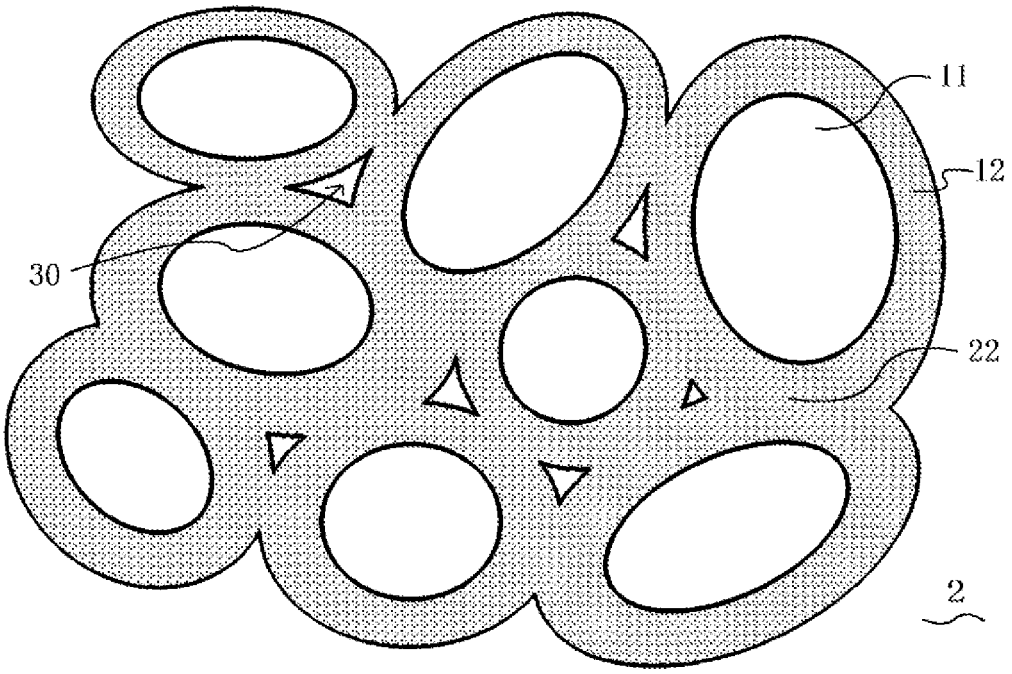
FIG. 9 is a section view providing a schematic illustration of the fine structure of the magnetic material in a comparative example.

The same alloy powder used in Example 1, except that the aforementioned $Fe_{Metal}/(Fe_{Metal}+Fe_{Oxide})$ was 0.15, was used to manufacture a grain compact based on the same operation as described in Example 1. Unlike in Example 1, in Comparative Example 1 the commercial alloy powder was dried for 12 hours in a thermostatic chamber set to 200° C. The magnetic permeability was 36 before the heat treatment, and also 36 after the heat treatment, meaning that the magnetic permeability of the grain compact did not increase. Binding parts 21 where metal grains were directly bonded together could not be found on the ×3000 SEM observation image of this grain compact. To be specific, the number of metal grains 11, or N, was 24, while the number of bonding parts 21 where metal grains 11 were directly bonded together, or B, was 0, according to this observation image, thereby giving a B/N ratio of 0. FIG. 9 is a section view giving a schematic illustration of the fine structure of the grain compact in Comparative Example 1. As evident from a grain compact 2 illustrated schematically in FIG. 9, the grain compact obtained in this comparative example did not have direct bonds between metal grains 11, and only bonds via oxide film 12 were found. Composition analysis of the oxide film 12 on the obtained grain compact revealed that 0.8 mol of Cr element was contained per 1 mol of Fe element.

EXAMPLE 2

Material Grain

A commercial alloy powder manufactured by the atomization method, having a composition of 5.0 percent by weight of Al, 3.0 percent by weight of Si and Fe constituting the remainder, and average grain size d50 of 10 μm, was used as the material grain. An aggregate surface of this alloy powder was analyzed by XPS and the aforementioned $Fe_{Metal}/(Fe_{Metal}+Fe_{Oxide})$ was calculated as 0.21.

Manufacturing of Grain Compact

One hundred parts by weight of material grains thus prepared were mixed under agitation with 1.5 parts by weight of acrylic binder whose thermal decomposition temperature was 400° C., after which 0.5 percent by weight of zinc stearate was added as lubricant. Then, the mixture was compacted to a specific shape under 8 t/cm$^2$, and the compact was heat-treated at 750° C. for 1 hour in an oxidizing ambience of 20.6% in oxygen concentration, to obtain a grain compact. When the characteristics of the obtained grain compact were measured, its magnetic permeability was 33 after the heat treatment compared to 24 before the heat treatment. The specific resistance was $3\times10^5$ Ωcm and strength was 6.9 kgf/mm$^2$. On the SEM observation image, the number of metal grains 11, or N, was 55, while the number of bonding parts 21 where metal grains 11 were directly bonded together, or B, was 11, thereby giving a B/N ratio of 0.20. Composition analysis of the oxide film 12 on the obtained grain compact revealed that 2.1 mol of Al element was contained per 1 mol of Fe element.

EXAMPLE 3

Material Grain

A commercial alloy powder manufactured by the atomization method, having a composition of 4.5 percent by weight of Cr, 6.5 percent by weight of Si and Fe constituting the remainder, and average grain size d50 of 6 μm, was used as the material grain. An aggregate surface of this alloy powder was analyzed by XPS and the aforementioned $Fe_{Metal}/(Fe_{Metal}+Fe_{Oxide})$ was calculated as 0.22.

Manufacturing of Grain Compact

One hundred parts by weight of material grains thus prepared were mixed under agitation with 1.5 parts by weight of acrylic binder whose thermal decomposition temperature was 400° C., after which 0.5 percent by weight of zinc stearate was added as lubricant. Then, the mixture was compacted to a specific shape under 8 t/cm$^2$, and the compact was heat-treated at 750° C. for 1 hour in an oxidizing ambience of 20.6% in oxygen concentration, to obtain a grain compact. When the characteristics of the obtained grain compact were measured, its magnetic permeability was 37 after the heat treatment compared to 32 before the heat treatment. The specific resistance was $4\times10^6$ Ωcm and strength was 7.8 kgf/mm$^2$. On the SEM observation image, the number of metal grains 11, or N, was 51, while the number of bonding parts 21 where metal grains 11 were directly bonded together, or B, was 9, thereby giving a B/N ratio of 0.18. Composition analysis of the oxide film 12 on the obtained grain compact revealed that 1.2 mol of Al element was contained per 1 mol of Fe element.

EXAMPLE 4

Material Grain

A commercial alloy powder manufactured by the atomization method, having a composition of 4.5 percent by weight of Cr, 3.5 percent by weight of Si and Fe constituting the remainder, and average grain size d50 of 10 μm, was heat-treated at 700° C. for 1 hour in a hydrogen ambience, and the resulting alloy powder was used as the material grain. An aggregate surface of this alloy powder was analyzed by XPS and the aforementioned $Fe_{Metal}/(Fe_{Metal}+Fe_{Oxide})$ was calculated as 0.55.

Manufacturing of Grain Compact

One hundred parts by weight of material grains thus prepared were mixed under agitation with 1.5 parts by weight of acrylic binder whose thermal decomposition temperature is 400° C., after which 0.5 percent by weight of zinc stearate was added as lubricant. Then, the mixture was compacted to a specific shape under 8 t/cm$^2$, and the compact was heat-treated at 750° C. for 1 hour in an oxidizing ambience of 20.6% in oxygen concentration, to obtain a grain compact. When the characteristics of the obtained grain compact were measured, its magnetic permeability was 54 after the heat treatment compared to 36 before the heat treatment. The specific resistance was $8\times10^3$ Ωcm and strength was 2.3 kgf/mm$^2$. On the SEM observation image of the obtained grain compact, the number of metal grains 11, or N, was 40, while the number of bonding parts 21 where metal grains 11 were directly bonded together, or B, was 15, thereby giving a B/N ratio of 0.38. Composition analysis of the oxide film 12 on the obtained grain compact revealed that 1.5 mol of Cr element was contained per 1 mol of Fe element. In this example, $Fe_{Metal}/(Fe_{Metal}+Fe_{Oxide})$ was large and specific resistance and strength were somewhat low, but magnetic permeability increased.

EXAMPLE 5

Material Grain

The same alloy powder used in Example 1 was used as the material grain.

Manufacturing of Grain Compact

One hundred parts by weight of material grains thus prepared were mixed under agitation with 1.5 parts by weight of acrylic binder whose thermal decomposition temperature was 400° C., after which 0.5 percent by weight of zinc stearate was added as lubricant. Then, the mixture was compacted to a specific shape under 8 t/cm$^2$, and the compact was heat-treated at 850° C. for 1 hour in an oxidizing ambience of 20.6% in oxygen concentration, to obtain a grain compact. When the characteristics of the obtained grain compact were measured, its magnetic permeability was 39 after the heat treatment compared to 36 before the heat treatment. The specific resistance was $6.0\times10^5$ Ωcm and strength was 9.2 kgf/mm$^2$. On the SEM observation image of the obtained grain compact, the number of metal grains 11, or N, was 44, while the number of bonding parts 21 where metal grains 11 were directly bonded together, or B, was 5, thereby giving a B/N ratio of 0.11. Composition analysis of the oxide film 12 on the obtained grain compact revealed that 1.1 mol of Cr element was contained per 1 mol of Fe element.

EXAMPLE 6

In this example, a coiled chip inductor was manufactured as a coil component.

Figure 3:
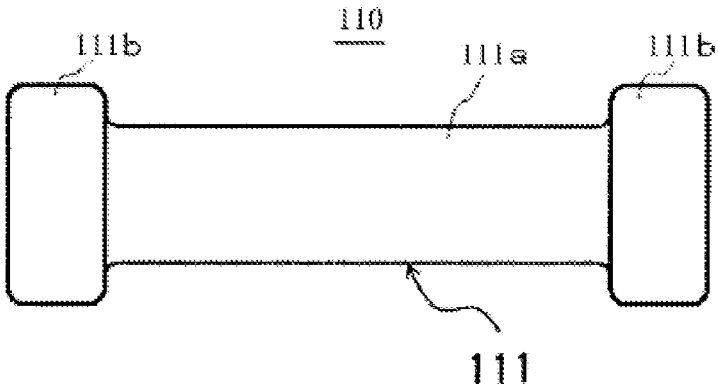
FIG. 3 is a side view showing the exterior of the magnetic material manufactured in an example of the present invention.
Figure 4:
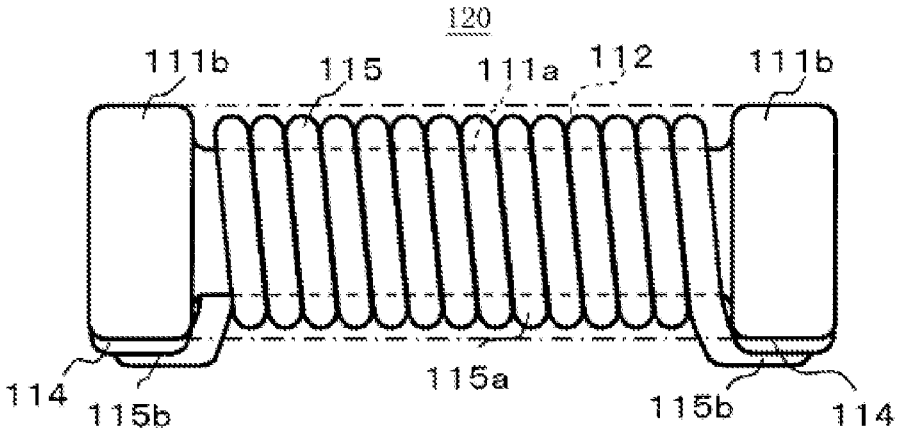
FIG. 4 is a perspective side view showing a part of the example of a coil component manufactured in an example of the present invention.
Figure 5:
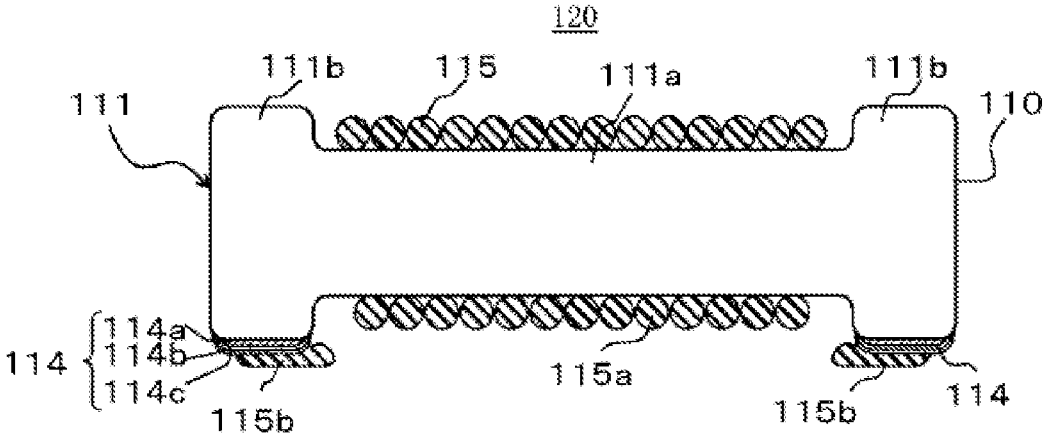
FIG. 5 is a longitudinal section view showing the internal structure of the coil component in FIG. 4.

FIG. 3 is a side view showing the exterior of the magnetic material manufactured in this example. FIG. 4 is a perspective side view showing a part of the example of the coil component manufactured in this example. FIG. 5 is a longitudinal section view showing the internal structure of the coil component in FIG. 4. A magnetic material 110 shown in FIG. 3 is used as a magnetic core around which the coil of the coiled chip inductor is wound. A drum-shaped magnetic core 111 has a plate-like winding core 111*a* placed in parallel with the mounting surface of the circuit board, etc., and used to wind the coil around it, as well as a pair of flanges 111*b* placed on the opposing ends of the winding core 111*a*, respectively, and its exterior has a drum shape. The ends of the coil are electrically connected to external conductive films 114 formed on the surfaces of the flanges 111*b*. The winding core 111*a* was sized to 1.0 mm wide, 0.36 mm high, and 1.4 mm long. The flange 111*b* was sized to 1.6 mm wide, 0.6 mm high, and 0.3 mm thick.

A coiled chip inductor 120, which is a coil component, has the aforementioned magnetic core 111 and a pair of plate-like magnetic cores 112 not illustrated. These magnetic core 111 and plate-like magnetic cores 112 are constituted by the magnetic material 110 which was manufactured from the same material grain used in Example 1 under the same conditions used in Example 1. The plate-like magnetic cores 112 connect the two flanges 111*b*, 111*b* of the magnetic core 111, respectively. The plate-like magnetic core 112 was sized to 2.0 mm long, 0.5 mm wide, and 0.2 mm thick. A pair of external conductive films 114 are formed on the mounting surfaces of the flanges 111*b* of the magnetic core 111, respectively. Also, a coil 115 constituted by an insulating sheathed conductive wire is wound around the winding core 111*a* of the magnetic core 111 to form a winding part 115*a*, while two ends 115*b* are thermocompression-bonded to the external conductive films 114 on the mounting surfaces of the flanges 111*b*, respectively. The external conductive film 114 has a baked conductive layer 114*a* formed on the surface of the magnetic material 110, as well as a Ni plating layer 114*b* and Sn plating layer 114*c* laminated on this baked conductive layer 114*a*. The aforementioned plate-like magnetic cores 112 are bonded to the flanges 111*b*, 111*b* of the magnetic core 111 by resin adhesive. The external conductive film 114 is formed on the surface of the magnetic material 110, and the end of the magnetic core is connected to the external conductive film 114. The external conductive film 114 was formed by baking a glass-added silver paste onto the magnetic material 110 at a specified temperature. Specifically, when the baked conductive film layer 114*a* of the external conductive film 114 on the surface of the magnetic material 110 was manufactured, a baking-type electrode material paste containing metal grains and glass frit (baking-type Ag paste was used in this example) was applied onto the mounting surface of the flange 111*b* of the magnetic core 111 constituted by the magnetic material 110, and then heat-treated in air to sinter and fix the electrode material directly onto the surface of the magnetic material 110. A coil-type chip inductor, which is a coil component, was thus manufactured.

EXAMPLE 7

In this example, a laminated inductor was manufactured as a coil component.

Figure 6:
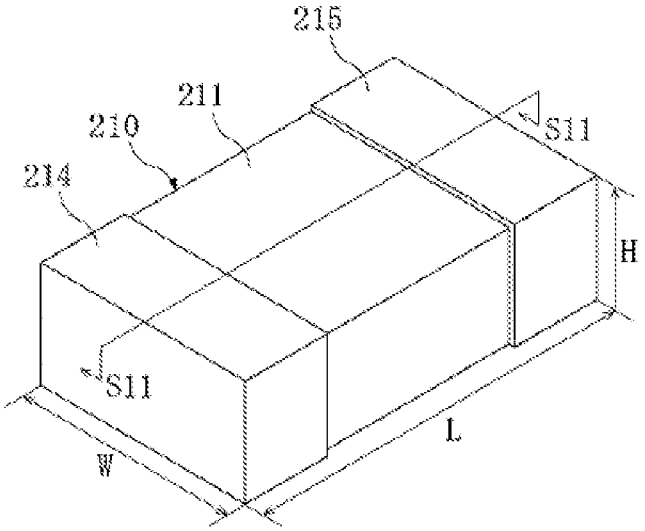
FIG. 6 is a perspective view of the exterior of a laminated inductor.
Figure 7:
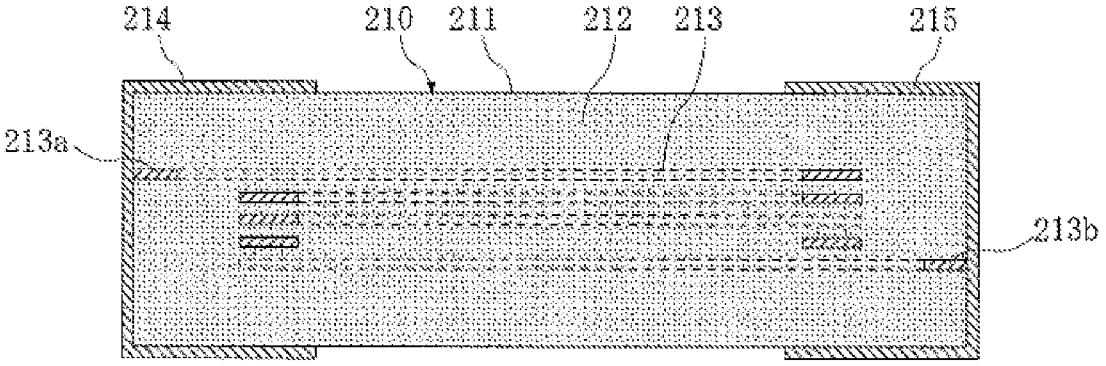
FIG. 7 is an enlarged section view of FIG. 6, cut along line S11-S11.
Figure 8:
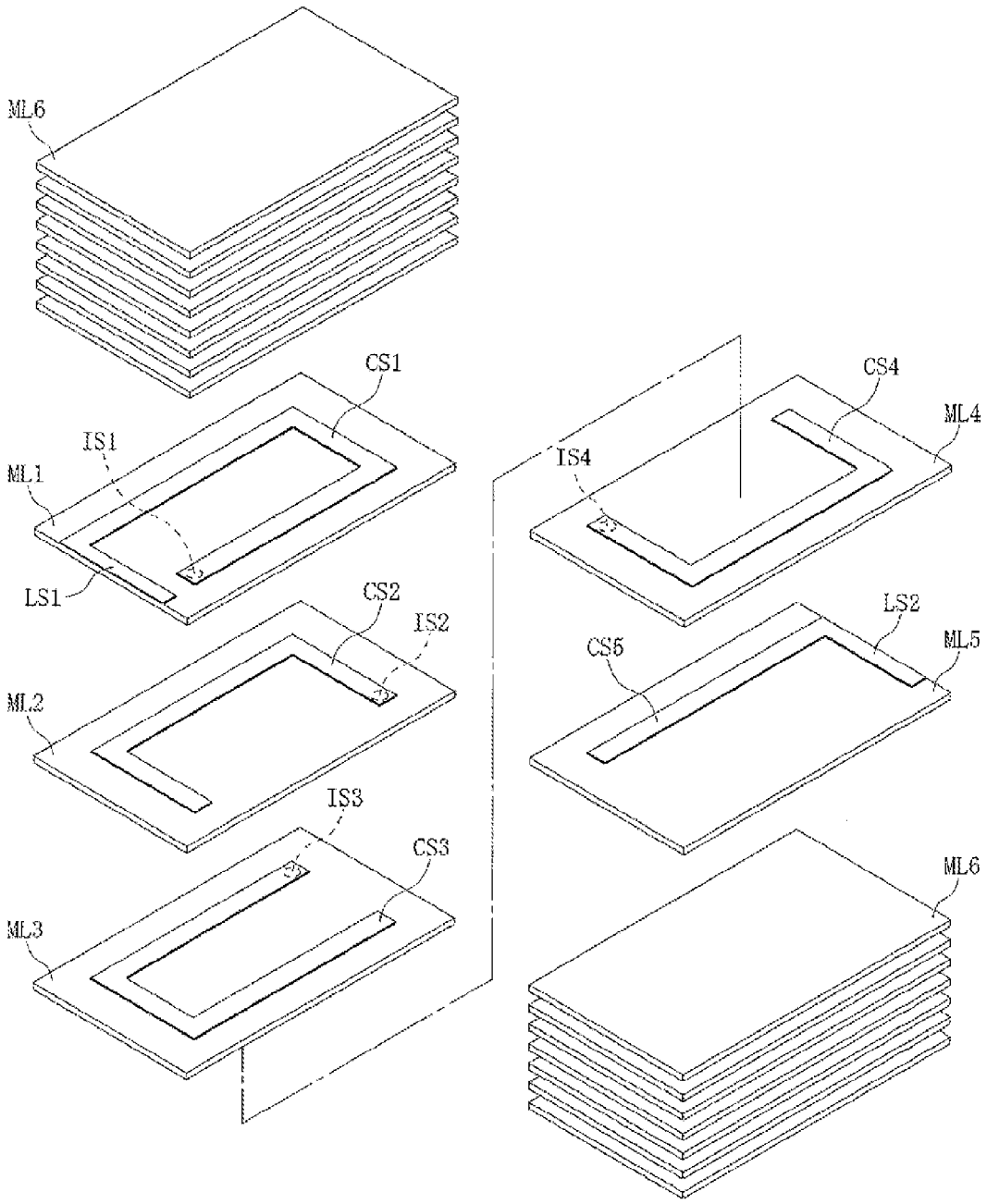
FIG. 8 is an exploded view of the component body shown in FIG. 6.

FIG. 6 is a perspective view of the exterior of a laminated inductor. FIG. 7 is an enlarged section view of FIG. 6, cut along line S11-S11. FIG. 8 is an exploded view of the component body shown in FIG. 6. A laminated inductor 210 manufactured in this example has an overall shape of rectangular solid with a length L of approx. 3.2 mm, width W of approx. 1.6 mm and height H of approx. 0.8 mm, in FIG. 6. This laminated inductor 210 comprises a component body 211 of rectangular solid shape, as well as a pair of external terminals 214, 215 provided on both longitudinal ends of the component body 211. As shown in FIG. 7, the component body 211 has a magnetic material part 212 of rectangular solid shape, and a spiral coil 213 covered with the magnetic material part 212, with one end of the coil 213 connected to the external terminal 214 and the other end connected to the external terminal 215. As shown in FIG. 8, the magnetic material part 212 has a structure of a total of 20 magnetic layers ML1 to ML6 integrated together, where the length is approx. 3.2 mm, width is approx. 1.6 mm, and height is approx. 0.8 mm. The magnetic layers ML1 to ML6 each have a length of approx. 3.2 mm, width of approx. 1.6 mm, and thickness of approx. 40 μm. The coil 213 has a structure of a total of five coil segments CS1 to CS5, and a total of four relay segments IS1 to IS4 connecting the coil segments CS1 to CS5, integrated together in a spiral form, where the number of windings is approx. 3.5. The material for this coil 213 is an Ag grain whose d50 is 5 μm.

The four coil segments CS1 to CS4 have a C shape, and the one coil segment CS5 has a band shape. The coil segments CS1 to CS5 each have a thickness of approx. 20 μm and width of approx. 0.2 mm. The top coil segment CS1 has, as a continuous part, an L-shaped leader part LS1 used to connect to the external terminal 214, while the bottom coil segment CS5 has, as a continuous part, an L-shaped leader part LS2 used to connect to the external terminal 215. The relay segments IS1 to IS4 each have a columnar shape penetrating the magnetic layers ML1 to ML4, and each has a bore of approx. 15 μm. The external terminals 214, 215 each extend to each longitudinal end face of the component body 211 and the four side faces near the end face, and each has a thickness of approx. 20 μm. The one external terminal 214 connects to the edge of the leader part LS1 of the top coil segment CS1, while the other external terminal 215 connects to the edge of the leader part LS2 of the bottom coil segment CS5. The material for these external terminals 214, 215 is an Ag grain whose d50 is 5 μm.

In manufacturing the laminated inductor 210, a doctor blade was used as a coater to apply a premixed magnetic paste onto the surfaces of plastic base films (not illustrated) and then dried using a hot-air dryer under the conditions of approx. 80° C. for approx. 5 minutes, to prepare first through sixth sheets, respectively corresponding to the magnetic layers ML1 to ML6 (refer to FIG. 8) and having an appropriate size for multi-part forming. The magnetic paste contained the material grain used in Example 1 by 85 percent by weight, butyl carbitol (solvent) by 13 percent by weight, and polyvinyl butyral (binder) by 2 percent by weight. Next, a stamping machine was used to puncture the first sheet corresponding to the magnetic layer ML1, to form through holes in a specific arrangement corresponding to the relay segment IS1. Similarly, through holes corresponding to the relay segments IS2 to IS4 were formed in specific arrangements in the second through fourth sheets corresponding to the magnetic layers ML2 to ML4.

Next, a screen printer was used to print a premixed conductive paste onto the surface of the first sheet corresponding to the magnetic layer ML1 and then dried using a hot-air dryer under the conditions of approx. 80° C. for approx. 5 minutes, to prepare a first printed layer corresponding to the coil segment CS1 in a specific arrangement. Similarly, second through fifth printed layers corresponding to the coil segments CS2 to CS5 were prepared in specific arrangements on the surfaces of the second through fifth sheets corresponding to the magnetic layers ML2 to ML5. The composition of the conductive paste was 85 percent by weight of Ag material, 13 percent by weight of butyl carbitol (solvent) and 2 percent by weight of polyvinyl butyral (binder). Since the through holes formed in specific arrangements in the first through fourth sheets corresponding to the magnetic layers ML1 to ML4, respectively, are positioned in a manner overlapping with the ends of the first through fourth printed layers in specific arrangements, respectively, the conductive paste is partially filled in each through hole when the first through fourth printed layers are printed, and first through fourth fill parts corresponding to the relay segments IS1 to IS4 are formed as a result.

Next, a pickup transfer machine and press machine (both are not illustrated) were used to stack the first through fourth sheets having printed layers and fill parts on them (corresponding to the magnetic layers ML1 to ML4), a fifth sheet having only a printed layer on it (corresponding to the magnetic layer ML5), and sixth sheet having no printed layer or fill area on it (corresponding to the magnetic layer ML6), in the order shown in FIG. 8, after which the stacked sheets were thermocompression-bonded to prepare a laminate. Next, a dicer was used to cut the laminate to the component body size to prepare a chip before heat treatment (including the magnetic material part and coil before heat treatment). Next, a sintering furnace, etc., was used to heat multiple chips before heat treatment in batch in an atmospheric ambience. This heat treatment included a binder removal process and oxide film forming process, where the binder removal process was implemented under the conditions of approx. 300° C. for approx. 1 hour, while the oxide film forming process was implemented under the conditions of approx. 750° C. for approx. 2 hours. Next, a dip coater was used to apply the aforementioned conductive paste onto both longitudinal ends of the component body 211 which was then baked in a sintering furnace under the conditions of approx. 600° C. for approx. 1 hour, thereby eliminating the solvent and binder while sintering the Ag grains through the baking process, to prepare external terminals 214, 215. A laminated inductor, which is a coil component, was thus manufactured.

INDUSTRIAL FIELD OF APPLICATION

According to the present invention, further size reduction and performance improvement of coil components used in the field of electronics components will likely be achieved.

Although specific embodiments were described in this Specification, those skilled in the art understand that various modifications and replacements may apply to the aforementioned devices and technologies to the extent allowed within the claims of the present invention specified in the attachment.

We claim:

1. A magnetic material containing multiple metal grains constituted by soft magnetic alloy and oxide film formed on a surface of the metal grains, wherein the soft magnetic alloy and the oxide film include Fe and a metal element that oxidizes more easily than Fe, wherein the magnetic material forms a grain compact having first bonding parts where adjacent metal grains are contacted and directly bonded together by alloy-to-alloy bonding in areas where no oxide film exists, second bonding parts where adjacent metal grains are bonded together by the oxide film formed around the entire surface of said adjacent metal grains other than the first bonding parts, and voids formed in an area other than the first and second bonding parts and surrounded by the oxide film, said alloy-to-alloy bonding including metal bonds where regularity of atomic arrangement is satisfied.

2. A magnetic material according to claim 1, wherein the soft magnetic alloy contains Si in an amount of 0.5 to 7.0 percent by weight.

3. A magnetic material according to claim 1, wherein the oxide film formed on the surface of the metal grains contains Cr or Al.

4. A magnetic material according to claim 1, wherein the average grain size of the metal grains is 2 to 30 μm.

5. A magnetic material according to claim 1, wherein the grain compact has a magnetic permeability of 33 to 54.

6. A magnetic material according to claim 2, wherein the grain compact has a magnetic permeability of 33 to 54.

7. A magnetic material according to claim 3, wherein the grain compact has a magnetic permeability of 33 to 54.

8. A magnetic material according to claim 4, wherein the grain compact has a magnetic permeability of 33 to 54.

9. The magnetic material according to claim 1, wherein the grains are bonded together only by the first bonding parts and the second bonding parts.

10. The magnetic material according to claim 1, wherein the grain compact is a sintered compact.

* * * * *